US010357091B1

(12) United States Patent
Solomons

(10) Patent No.: US 10,357,091 B1
(45) Date of Patent: Jul. 23, 2019

(54) HAIR PRODUCT-DISPENSING CONTAINER

(71) Applicant: Ruth Solomons, Highlands Ranch, CO (US)

(72) Inventor: Ruth Solomons, Highlands Ranch, CO (US)

( * ) Notice: Subject to any disclaimer, the term of this patent is extended or adjusted under 35 U.S.C. 154(b) by 0 days.

(21) Appl. No.: 16/267,502

(22) Filed: Feb. 5, 2019

(51) Int. Cl.
*A45D 7/02* (2006.01)
*A45D 19/02* (2006.01)

(52) U.S. Cl.
CPC ..... *A45D 19/02* (2013.01); *A45D 2019/025* (2013.01)

(58) Field of Classification Search
CPC . A46B 11/0037; A46B 11/0041; A45D 19/00; A45D 19/0008; A45D 19/02; A45D 2019/025; A45D 2019/0033; A45D 2019/0066; A45D 2019/0075; A45D 24/22; A45D 24/24; A45D 24/28; B67D 1/0001; B67D 1/0462; B65D 2231/00
See application file for complete search history.

(56) References Cited

U.S. PATENT DOCUMENTS 2,381,048 A 2/1944 Arne
4,121,602 A 10/1978 Young
6,168,335 B1 1/2001 Mears
6,260,557 B1 7/2001 Yarbrough
7,077,146 B1 7/2006 Eckerson
D643,293 S 8/2010 Tiram
9,210,982 B2 * 12/2015 Alsalameh ..... A45D 24/22
2007/0221242 A1 * 9/2007 Elliott ..... A45D 19/0008 132/270

FOREIGN PATENT DOCUMENTS

CA 2340959 8/1998
CH 304890 * 4/1955
CH 707491 A2 * 1/2013

* cited by examiner

*Primary Examiner* — Rachel R Steitz

(57) ABSTRACT

The hair product-dispensing container is configured for use with a plurality of lotions. Each of the plurality of lotions is configured for use with the hair of a end user. The hair product-dispensing container simultaneously and independently dispenses each of the plurality of lotions into the hair of the end user. By independently is meant that the plurality of lotions are not mixed together before the plurality of lotions are dispensed into the hair of the end user by the hair product-dispensing container. The hair product-dispensing container comprises a master reservoir and the master plunger. The master reservoir stores and dispenses the plurality of lotions. The master plunger provides the motive forces necessary to simultaneously dispense the plurality of lotions from the master reservoir.

14 Claims, 6 Drawing Sheets

HAIR PRODUCT-DISPENSING CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including hairdressing equipment such as devices for washing and coloring hair, more specifically, a hand-actuated device for applying one or more substances without prior mixing. (A45D2019/025)

SUMMARY OF INVENTION

The hair product-dispensing container is configured for use with a plurality of lotions. Each of the plurality of lotions is configured for use with the hair of a end user. The hair product-dispensing container simultaneously and independently dispenses each of the plurality of lotions into the hair of the end user. By independently is meant that the plurality of lotions are not mixed together before the plurality of lotions are dispensed into the hair of the end user by the hair product-dispensing container. The hair product-dispensing container comprises a master reservoir and the master plunger. The master reservoir stores and dispenses the plurality of lotions. The master plunger provides the motive forces necessary to simultaneously dispense the plurality of lotions from the master reservoir.

These together with additional objects, features and advantages of the hair product-dispensing container will be readily apparent to those of ordinary skill in the art upon reading the following detailed description of the presently preferred, but nonetheless illustrative, embodiments when taken in conjunction with the accompanying drawings.

In this respect, before explaining the current embodiments of the hair product-dispensing container in detail, it is to be understood that the hair product-dispensing container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hair product-dispensing container.

It is therefore important that the claims be regarded as including such equivalent construction insofar as they do not depart from the spirit and scope of the hair product-dispensing container. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
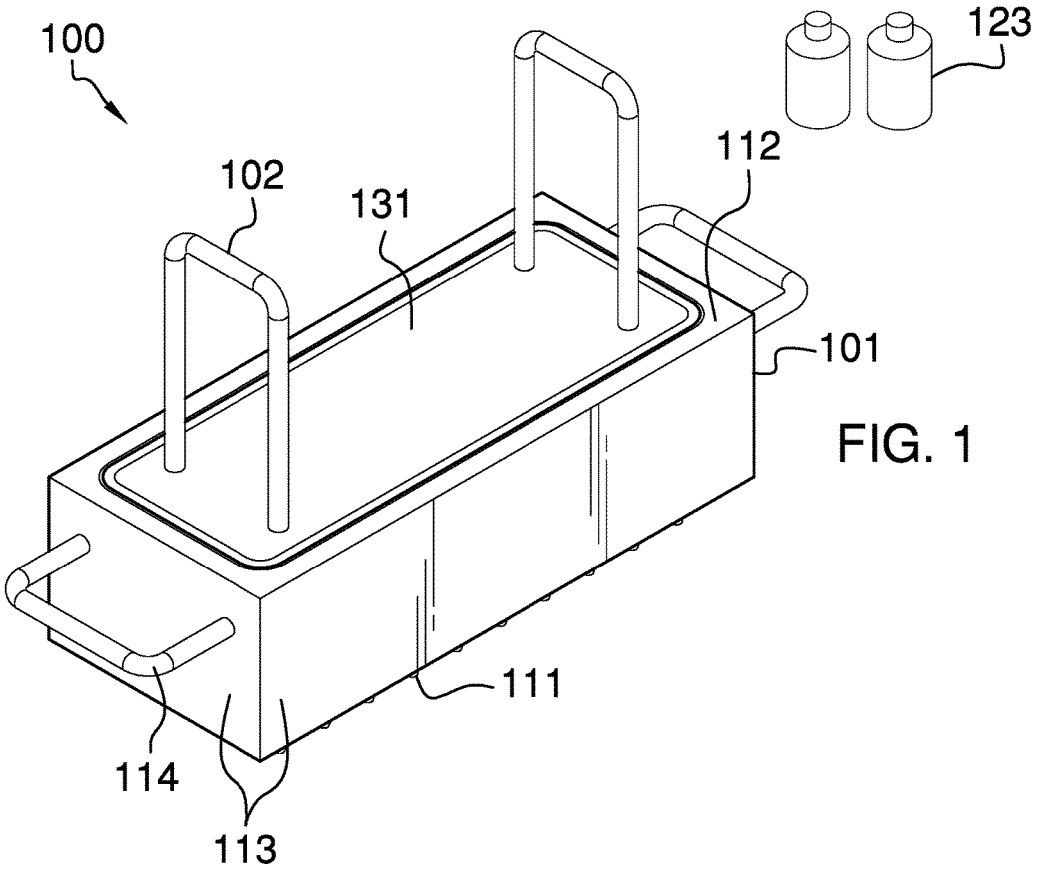
FIG. 1 is a perspective view of an embodiment of the disclosure.
Figure 2:
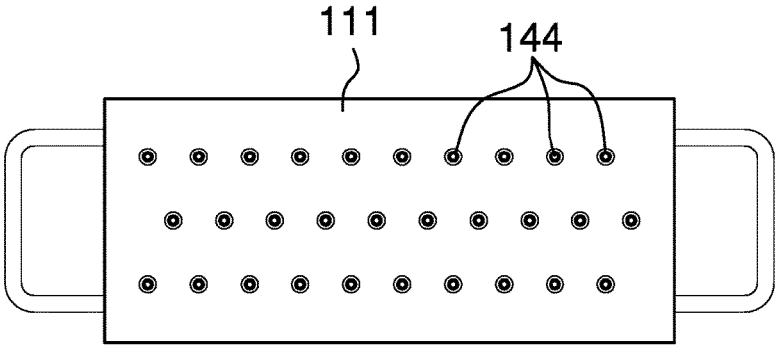
FIG. 2 is a bottom view of an embodiment of the disclosure.
Figure 3:
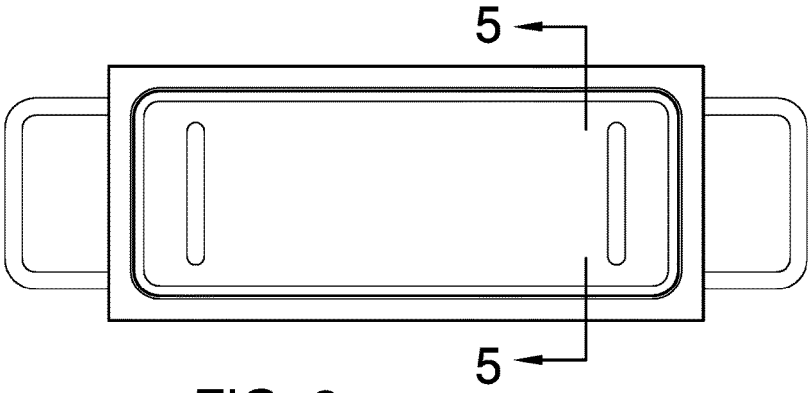
FIG. 3 is a top closed view of an embodiment of the disclosure.
Figure 4:
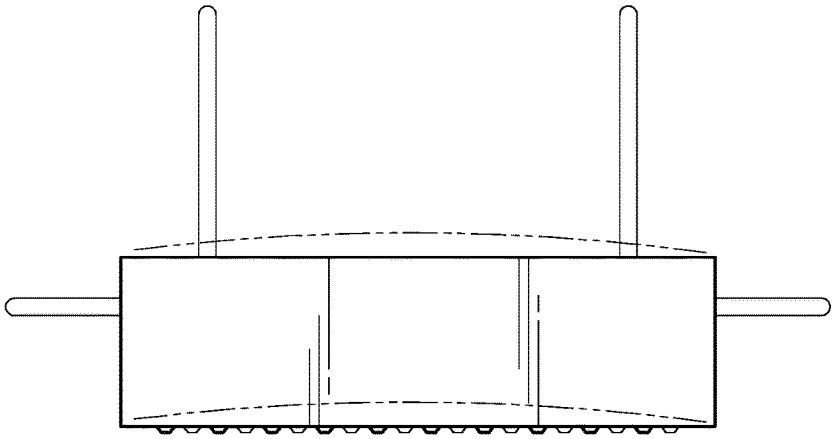
FIG. 4 is a side view of an embodiment of the disclosure.
Figure 5:
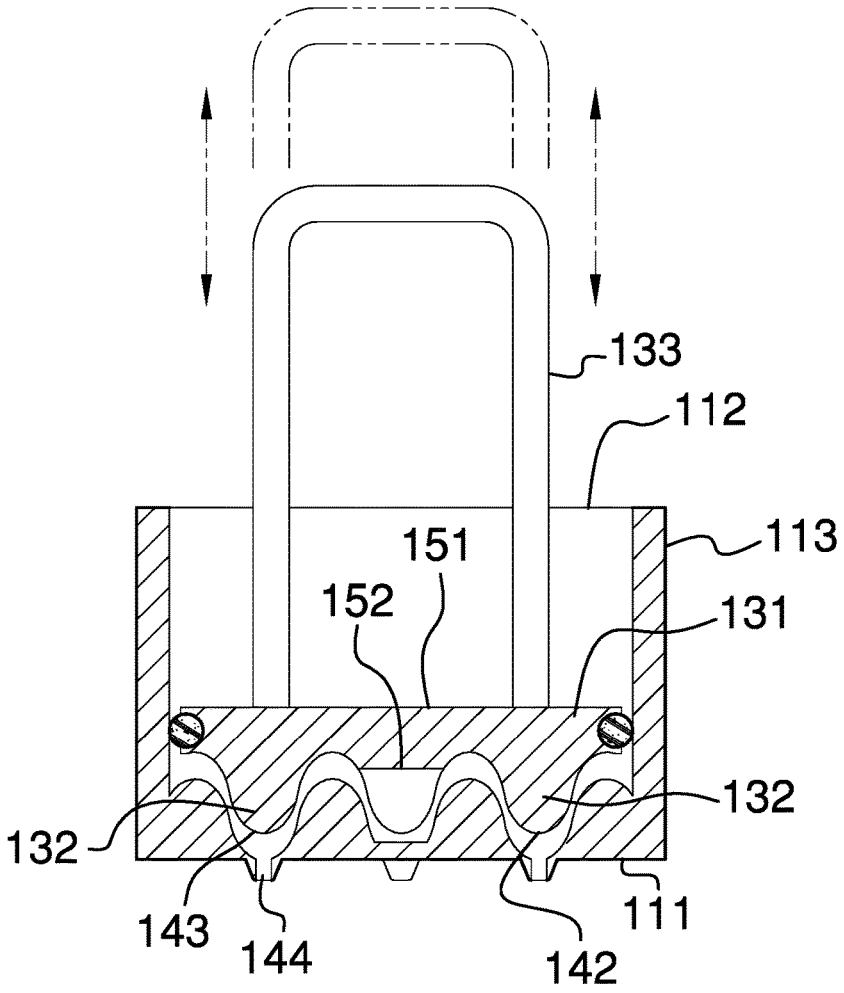
FIG. 5 is a cross-sectional view of an embodiment of the disclosure across 5-5 as shown in FIG. 3.
Figure 6:
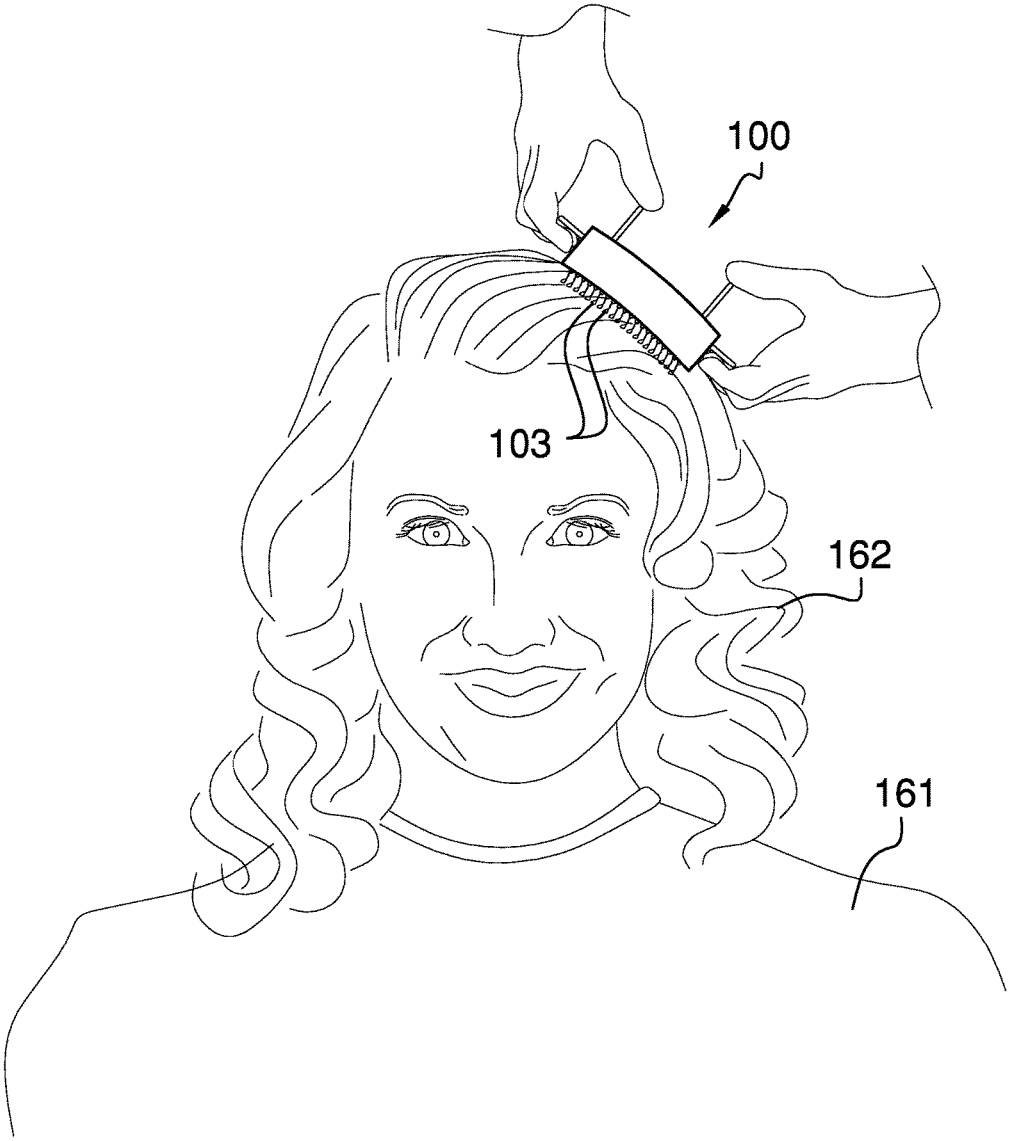
FIG. 6 is an in-use view of an embodiment of the disclosure.
Figure 7:
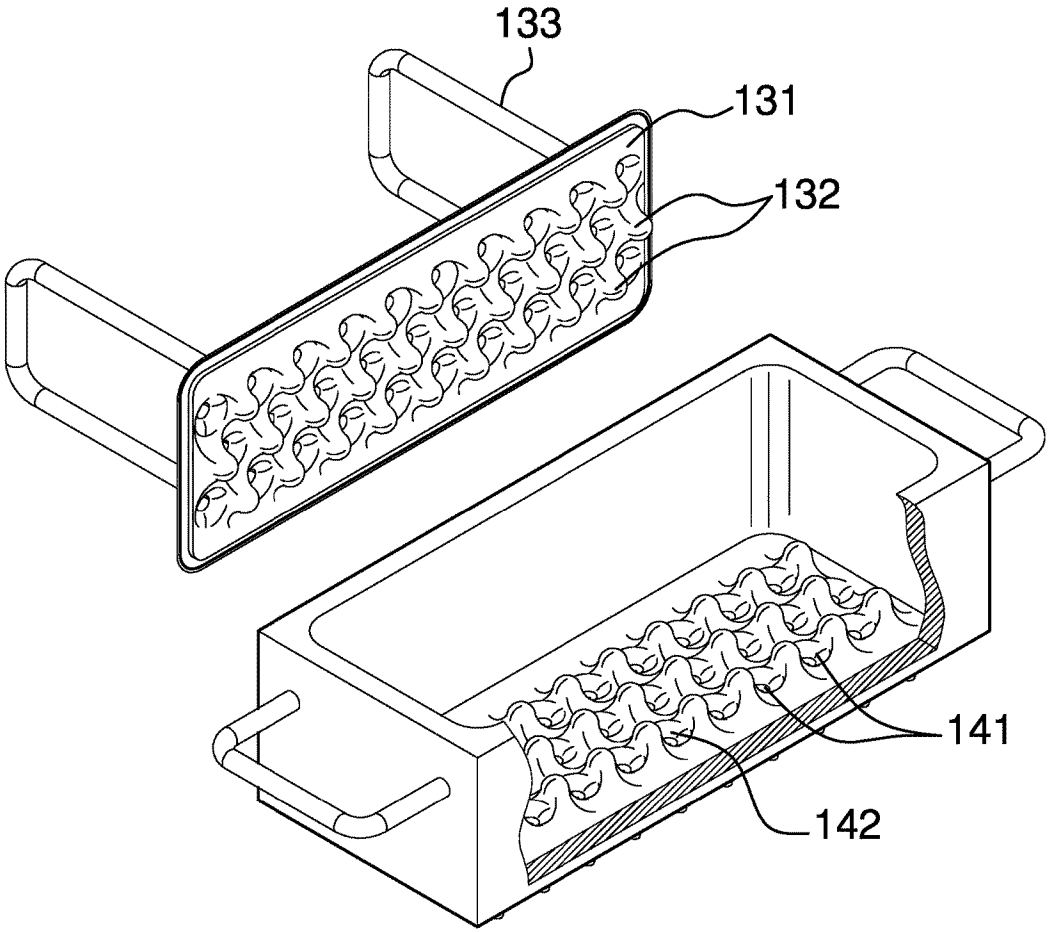
FIG. 7 is an exploded view of an embodiment of the disclosure.
Figure 8:
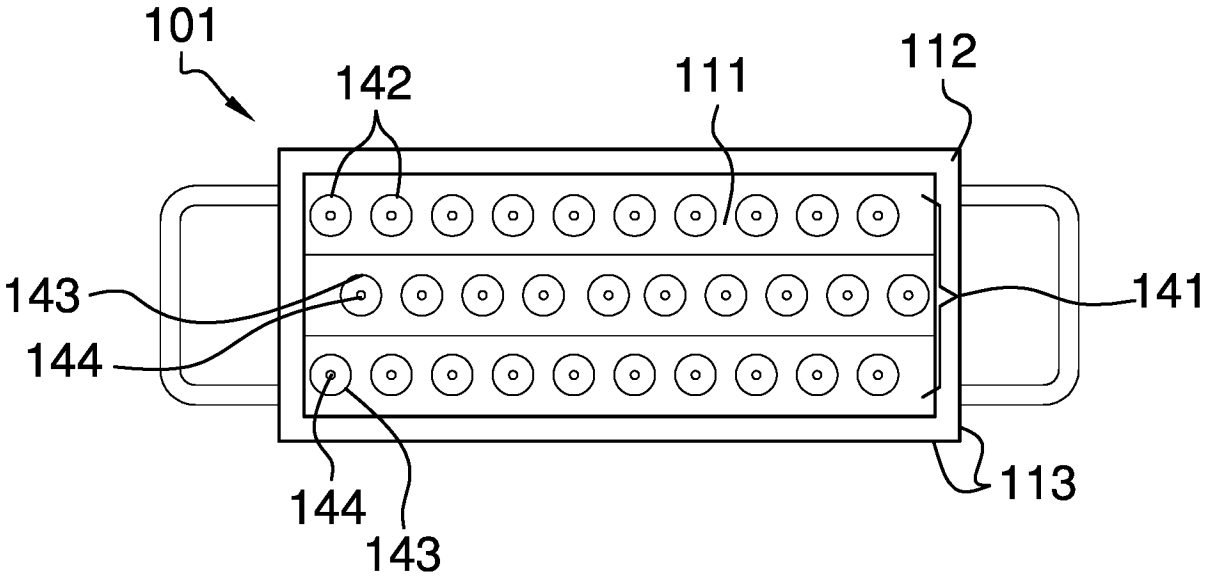
FIG. 8 is a top open view of an embodiment of the disclosure.

Detailed reference will now be made to one or more potential embodiments of the disclosure, which are illustrated in FIGS. 1 through 8.

The hair product-dispensing container 100 (hereinafter invention) is configured for use with a plurality of lotions 103. Each of the plurality of lotions 103 is configured for use with the hair 162 of a end user 161. The invention 100 simultaneously and independently dispenses each of the plurality of lotions 103 into the hair 162 of the end user 161. By independently is meant that the plurality of lotions 103 are not mixed together before the plurality of lotions 103 are dispensed into the hair 162 of the end user 161 by the invention 100. The invention 100 comprises a master reservoir 101 and the master plunger 102. The master reservoir 101 stores and dispenses the plurality of lotions 103. The master plunger 102 provides the motive forces necessary to simultaneously dispense the plurality of lotions 103 from the master reservoir 101.

Each of the plurality of lotions 103 is a liquid. Each of the plurality of lotions 103 is a chemical compound adapted for use with the hair 162 of the end user 161. The applicant prefers that each of the plurality of lotions 103 be a relatively viscous liquid such as a gel or a viscous colloid. The master reservoir 101 is the container that stores the plurality of lotions 103. The master reservoir 101 stores each of the plurality of lotions 103 in separate channels with wells.

The master reservoir 101 has a pan structure. The master reservoir 101 comprises a closed congruent face 111, an open congruent face 112, a plurality of lateral faces 113, and a first set of one or more handles 114.

The closed congruent face 111 is a semi-rigid structure with an elastic nature. The semi-rigid structure of the closed congruent face 111 allows the closed congruent face 111 to conform to the head of the end user 161 while the plurality of lotions 103 are dispensed. The closed congruent face 111 is the congruent face of the pan structure of the master reservoir 101 that is enclosed. The plurality of lotions 103 are dispensed through the closed congruent face 111. The closed congruent face 111 further comprises a plurality of wells 141.

Each of the plurality of wells 141 is a negative space that is formed in the interior face of the closed congruent face 111. Each of the plurality of wells 141 is identical. Each of the plurality of wells 141 has a semispherical shape. Each of the plurality of wells 141 stores a lotion selected from the plurality of lotions 103. Each of the plurality of wells 141 dispenses the selected lotion contained within each individual well structure 142 that contains a selected lotion.

The plurality of wells 141 comprises a collection of individual well structures 142. Each of the individual well structures 142 are identical. Each individual well structure 142 is a negative space with a semispherical structure. Each individual well structure 142 has a composite prism structure. Each individual well structure 142 contains a dose of a lotion selected from the plurality of lotions 103 during use of the invention 100. Each individual well structure 142 further comprises a well reservoir 143 and a flexible discharge nozzle 144.

The well reservoir 143 is the semicircular negative space formed by the individual well structure 142. The well reservoir 143 forms the containment space of the individual well structure 142 for the lotion selected from the plurality of lotions 103.

The flexible discharge nozzle 144 is a nozzle that forms a fluidic connection between the individual well structure 142 and the hair 162 of the end user 161 through the closed congruent face 111. The flexible discharge nozzle 144 forms the path through which the selected lotion is discharged. When the plunger selected from the plurality of individual plungers 132 for use in the individual well structure 142 inserts into the individual well structure 142 the selected plunger will force the selected lotion through the flexible discharge nozzle 144 directly on to the hair 162 of the end user 161. The flexible discharge nozzle 144 is formed from an elastomeric material such that the flexible discharge nozzle 144 deform when placed in contact with the head of the end user 161.

The open congruent face 112 is the open face of the pan structure of the master reservoir 101. The open congruent face 112 is distal from the closed congruent face 111. The open congruent face 112 of the master reservoir 101 is a congruent face of the prism structure that forms the pan of the master reservoir 101. The master plunger 102 inserts into the master reservoir 101 through the open congruent face 112. The plurality of lotions 103 are put into the master reservoir 101 through the open congruent face 112. The plurality of lotions 103 are introduced into the master reservoir 101 through the open congruent face 112 of the master reservoir 101.

The plurality of lateral faces 113 forms a rigid structure. Each of the plurality of lateral faces 113 projects perpendicularly away from the planar disk structure of the closed congruent face 111 in the manner of a cantilever. The span of the distance between the fixed end and the free end of each of the plurality of lateral faces 113 is identical. The free end of each of the plurality of lateral faces 113 are aligned such that the free end of each of the plurality of lateral faces 113 combine to form the open congruent face 112. Each of the plurality of lateral faces 113 are joined to form a fluid impermeable barrier. The plurality of lateral faces 113 and the closed congruent face 111 combine to form the enclosed space of the master reservoir 101.

The first set of one or more handles 114 form one or more grips that attach to the master reservoir 101. Each of the first set of one or more handles 114 attach to the exterior side of the master reservoir 101 formed by the plurality of lateral faces 113. Each of the first set of one or more handles 114 allows for the manipulation of the master reservoir 101 during use of the invention 100.

The master plunger 102 is a mechanical structure. The master plunger 102 inserts into the master reservoir 101. The master plunger 102 is geometrically similar to the hollow interior of the master reservoir 101. The master plunger 102 comprises a plurality of individual plungers 132 that provide the motive forces used to simultaneously dispense the plurality of lotions 103 as separate doses into the hair 162 of the end user 161. The master plunger 102 comprises a pressure plate 131, a plurality of individual plungers 132, and a second set of one or more handles 133. The pressure plate 131 is further defined with an exterior surface 151 and an interior surface 152.

The pressure plate 131 is a disk-shaped structure. The pressure plate 131 is geometrically similar to the open congruent face 112 of the master reservoir 101. The pressure plate 131 inserts into the open congruent face 112 of the master reservoir 101. The pressure plate 131 is a rigid structure.

Each of the plurality of individual plungers 132 is a semispherical structure that is formed on the interior surface 152 of the pressure plate 131. By interior surface 152 is meant the face of the disk structure of the pressure plate 131 that first enters the master reservoir 101. Each of the plurality of individual plungers 132 is identical. Each of the plurality of individual plungers 132 is geometrically similar to any individual well structure 142 selected from the plurality of wells 141. Each of the plurality of individual plungers 132 are aligned such that each individual plunger selected from the plurality of individual plungers 132 inserts into an individual well structure 142 selected from the plurality of wells 141 of the closed congruent face 111.

The inner diameter of each individual well structure 142 is greater than the outer diameter of any plunger selected from the plurality of individual plungers 132 of the master plunger 102 such that the selected plunger will insert into its associated individual well structure 142.

Each of the plurality of individual plungers 132 forms a piston within its selected individual well structure 142 such that the plunger associated with the selected individual well structure 142 will provide the motive forces required to discharge the lotion selected from the plurality of lotions 103 through the flexible discharge nozzle 144 of the individual well structure 142.

The second set of one or more handles 133 form one or more grips that attach to the master plunger 102. Each of the second set of one or more handles 133 attach to the exterior surface 151 of the pressure plate 131 of the master plunger 102. By exterior surface 151 is meant the face of the disk structure of the pressure plate 131 that is distal from the interior surface 152 of the pressure plate 131. Each of the second set of one or more handles 133 allows for the manipulation of the master plunger 102 during use of the invention 100.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Amino Acid: As used in this disclosure, an amino acid refers to a carbon atom that has a carboxyl functional group and an amine functional group. The standard amino acids refer to the twenty to twenty-two amino acids commonly used for biological functions. The range of twenty to twenty-two depends on the specific definition used in the specific context.

Atmosphere: As used in this disclosure, the atmosphere refers to a blanket of gases (primarily nitrogen and oxygen) that surround the earth. Typical atmospheric conditions are approximated and characterized as the normal temperature and pressure. Atmospheric gases are commonly called air.

Cavity: As used in this disclosure, a cavity is an empty space or negative space that is formed within an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Colloidal Suspension: As used in this disclosure, a colloidal suspension, or colloid for short, is a heterogeneous mixture of solute particles dissolved in a solvent. The colloidal suspension is referred to as heterogeneous because the distribution of the solute particles is not uniform through the solvent, usually because of the relatively large size of the particles.

Composite Prism: As used in this disclosure, a composite prism refers to a structure that is formed from a plurality of structures selected from the group consisting of a prism structure, a pyramid structure, and a spherical structure. The plurality of selected structures may or may not be truncated. The plurality of prism structures are joined together such that the center axes (or spherical diameter) of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Dose: As used in this disclosure, the term dose refers to a specified measured quantity of a chemical substance that is to be incorporated or introduced into an organism or a mixture such as a recipe or a solution. The term dose often, but not necessarily, implies the introduction of a therapeutic substance or a pharmacologically active media into a end user.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Exterior: As used in this disclosure, the exterior is used as a relational term that implies that an object is not contained within the boundary of a structure or a space.

Fiber: As used in this disclosure, a fiber is a slender, elongated structure.

Flexible: As used in this disclosure, flexible refers to an object or material that will deform when a force is applied to it but that will not necessarily return to its original shape when the deforming force is removed.

Form Factor: As used in this disclosure, the term form factor refers to the size and shape of an object.

Gel: As used in this disclosure, a gel is a substance comprising mostly of liquid (by mass) that is trapped in a cross-linked network of proteins and peptides that exhibits the properties of a solid.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Hair: As used in this disclosure, hair is refers to the fibrous keratin-based structure commonly seen growing from the skin of mammals.

Handheld: As used in this disclosure, when referring to an item or device, handheld means that the item or device is small and light enough: 1) to be operated while a person holds the item or device in their hands; and, 2) to be carried by hand over a distance.

Handle: As used in this disclosure, a handle is an object by which a tool, object, or door is held or manipulated with the hand.

Interior: As used in this disclosure, the interior is used as a relational term that implies that an object is contained within the boundary of a structure or a space.

Keratin: As used in this disclosure, keratin refers to a fibrous class a protein often used for structural purposes in a living organism. The protein structure of keratin will vary between species and with the structural function of the keratin within a species.

Liquid: As used in this disclosure, a liquid refers to a state (phase) of matter that is fluid and that maintains, for a given pressure, a fixed volume that is independent of the volume of the container.

Lotion: As used in this disclosure, a lotion is a smooth viscous liquid that is used for medical, hygienic, or cosmetic purposes. Lotions are commonly used as a delivery device for applying a pharmacologically active media such as an antibiotic ointment, a surfactant such as a soap, a skin moisturizer.

Negative Space: As used in this disclosure, negative space is a method of defining an object through the use of open or empty space as the definition of the object itself, or, through the use of open or empty space to describe the boundaries of an object.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent face of the prism structure that forms the pan; and, b) a lateral face of the prism structure that forms the pan.

End user: As used in this disclosure, a end user is a person who is designated to receive a medical treatment, therapy or service. The term end user may be extended to an animal when used within the context of the animal receiving veterinary treatment or services.

Peptide: As used in this disclosure, a peptide refers to a molecular sequence formed with one or more bonds between two or more amino acids. Unless otherwise stated in this disclosure, the amino acids are not limited to the standard amino acids. Piston: As used in this disclosure, a piston is a disk or shaft that closely that moves along its center axis Plate: As used in this disclosure, a plate is a smooth, flat and semi-rigid or rigid structure that has at least one dimension that: a) is of uniform thickness; and b) that appears thin relative to the other dimensions of the object. Plates are often disks. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board.

Plunger: As used in this disclosure, a plunger is a cylindrical piston that is used to pump fluids out of a chamber.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protein: As used in this disclosure, a protein refers to a linear molecular sequence of amino acids. Unless otherwise stated in this disclosure, a protein is exclusively formed from the standard amino acids.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Relaxed Shape: As used in this disclosure, a structure is considered to be in its relaxed state when no shear, strain, or torsional forces are being applied to the structure.

Reservoir: As used in this disclosure, a reservoir refers to a container or containment system that is configured to store a liquid.

Rigid Structure: As used in this disclosure, a rigid structure is a solid structure formed from an inelastic material that resists changes in shape. A rigid structure will permanently deform as it fails under a force.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Semisphere: As used in this disclosure, a semisphere is a structure formed in the shape of a half a sphere. Such a structure would be described as semispherical.

Viscosity: As used in this disclosure, viscosity refers to the resistance of a liquid or an elastic material to deformation. Higher viscosity would refer to a greater resistance to flow or to deformation.

Viscous: As used in this disclosure, a viscous material is a material with a viscosity such that the viscous material has characteristics intermediate between a liquid and a solid.

Viscous Colloid: As used in this disclosure, a viscous colloid is a colloidal suspension where the viscosity or flow rate of the colloid is such that the colloid will flow but can for all practical purposes be treated and contained as if it were a solid. In common usages, a viscous colloid is often referred to as a cream.

With respect to the above description, it is to be realized that the optimum dimensional relationship for the various components of the invention described above and in FIGS.

1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hair product dispensing apparatus comprising:
a master reservoir and a master plunger;
wherein the master plunger inserts into the master reservoir;
wherein the hair product dispensing apparatus is configured for use with a plurality of lotions;
wherein each of the plurality of lotions is configured for use with the hair of a user;
wherein the hair product dispensing apparatus simultaneously and independently dispenses each of the plurality of lotions into the hair of the end user;
wherein by independently is meant that the plurality of lotions are not mixed together before the plurality of lotions are dispensed into the hair of the user by the hair product dispensing apparatus;
wherein each of the plurality of lotions is a liquid;
wherein each of the plurality of lotions is a chemical compound adapted for use with the hair of a user;
wherein the master reservoir stores and dispenses the plurality of lotions;
wherein the master plunger provides the motive forces necessary to simultaneously dispense the plurality of lotions from the master reservoir;
wherein the master reservoir stores each of the plurality of lotions separately;
wherein the master reservoir has a pan structure;
wherein the master plunger is a mechanical structure;
wherein the master plunger inserts into the master reservoir;
wherein the master plunger is geometrically similar to the hollow interior of the master reservoir;
wherein the master plunger provides the motive forces that simultaneously dispense the plurality of lotions as separate doses into the hair of the user;
wherein the master reservoir comprises a closed congruent face, the open congruent face, a plurality of lateral faces, and a first set of one or more handles;
wherein the closed congruent face, an open congruent face, and the plurality of lateral faces form the pan structure of the master reservoir;
wherein the first set of one or more handles attach to the plurality of lateral faces;
wherein the master plunger comprises a pressure plate, a plurality of individual plungers, and a second set of one or more handles;
wherein the plurality of individual plungers and a second set of one or more handles attach to the pressure plate;
wherein the pressure plate is further defined with an exterior surface and an interior surface;
wherein the closed congruent face is a semi-rigid structure with an elastic nature;
wherein the closed congruent face is the congruent face of the pan structure of the master reservoir that is enclosed;
wherein the plurality of lotions are dispensed through the closed congruent face;
wherein the closed congruent face further comprises a plurality of wells;
wherein the plurality of wells comprises a collection of individual well structures;
wherein each individual well structure further comprises a well reservoir and a flexible discharge nozzle;
wherein the well reservoir is a semicircular negative space formed by the individual well structure.

2. The hair product dispensing apparatus according to claim 1
wherein each of the plurality of wells is a negative space that is formed in the interior face of the closed congruent face;
wherein each of the plurality of wells is identical;
wherein each of the plurality of wells stores a lotion selected from the plurality of lotions;
wherein each of the plurality of wells dispenses the selected lotion.

3. The hair product dispensing apparatus according to claim 2
wherein each of the individual well structures are identical;
wherein each individual well structure is a negative space;
wherein each individual well structure has a composite prism structure;
wherein each individual well structure contains a dose of a lotion selected from the plurality of lotions during use of the hair product dispensing apparatus.

4. The hair product dispensing apparatus according to claim 3
wherein the flexible discharge nozzle attaches to the well reservoir to form the composite prism structure.

5. The hair product dispensing apparatus according to claim 4
wherein the well reservoir forms the containment space of the individual well structure for the lotion selected from the plurality of lotions.

6. The hair product dispensing apparatus according to claim 5
wherein the flexible discharge nozzle is a nozzle that forms a fluidic connection between the individual well structure and the hair of the end user through the closed congruent face;
wherein the flexible discharge nozzle forms the path through which the selected lotion is discharged;
wherein the master plunger forces the selected lotion through the flexible discharge nozzle directly on to the hair of a user;
wherein the flexible discharge nozzle is formed from an elastomeric material.

7. The hair product dispensing apparatus according to claim 6
wherein the pressure plate is a disk-shaped structure;
wherein the pressure plate is a rigid structure;
wherein the pressure plate is geometrically similar to the open congruent face of the master reservoir;
wherein the pressure plate inserts into the open congruent face of the master reservoir.

8. The hair product dispensing apparatus according to claim 7 wherein each of the plurality of individual plungers is a semispherical structure that is formed on the interior surface of the pressure plate;

wherein by interior surface is meant the face of the disk structure of the pressure plate that first enters the master reservoir.

9. The hair product dispensing apparatus according to claim 8 wherein each of the plurality of individual plungers is identical;

wherein each of the plurality of individual plungers is geometrically similar to any individual well structure selected from the plurality of wells;

wherein each of the plurality of individual plungers are aligned such that each individual plunger selected from the plurality of individual plungers inserts into an individual well structure selected from the plurality of wells of the closed congruent face;

wherein the inner diameter of each individual well structure is greater than the outer diameter of any plunger selected from the plurality of individual plungers of the master plunger such that the selected plunger will insert into its associated individual well structure.

10. The hair product dispensing apparatus according to claim 9 wherein each of the plurality of individual plungers forms a piston within its selected individual well structure such that the plunger associated with the selected individual well structure will provide the motive forces required to discharge the lotion selected from the plurality of lotions through the flexible discharge nozzle of the individual well structure.

11. The hair product dispensing apparatus according to claim 10 wherein the open congruent face is the open face of the pan structure of the master reservoir;

wherein the open congruent face is distal from the closed congruent face;

wherein the open congruent face of the master reservoir is a congruent face of the prism structure that forms the pan of the master reservoir;

wherein the master plunger inserts into the master reservoir through the open congruent face;

wherein the plurality of lotions are put into the master reservoir through the open congruent face.

12. The hair product dispensing apparatus according to claim 11 wherein the plurality of lateral faces forms a rigid structure;

wherein each of the plurality of lateral faces projects perpendicularly away from the planar disk structure of the closed congruent face in the manner of a cantilever;

wherein the span of the distance between the fixed end and the free end of each of the plurality of lateral faces is identical;

wherein the free end of each of the plurality of lateral faces are aligned such that the free end of each of the plurality of lateral faces combine to form the open congruent face;

wherein each of the plurality of lateral faces are joined to form a fluid impermeable barrier;

wherein the plurality of lateral faces and the closed congruent face combine to form the enclosed space of the master reservoir.

13. The hair product dispensing apparatus according to claim 12 wherein the first set of one or more handles form one or more grips that attach to the master reservoir;

wherein each of the first set of one or more handles attach to the exterior side of the master reservoir formed by the plurality of lateral faces.

14. The hair product dispensing apparatus according to claim 13 wherein the second set of one or more handles form one or more grips that attach to the master plunger;

wherein each of the second set of one or more handles attach to the exterior surface of the pressure plate of the master plunger;

wherein by exterior surface is meant the face of the disk structure of the pressure plate that is distal from the interior surface of the pressure plate.

* * * * *